United States Patent [19]

Yamagata et al.

[11] 4,436,412

[45] Mar. 13, 1984

[54] CLEANING DEVICE FOR USE ON AN ELECTROSTATIC COPYING APPARATUS

[75] Inventors: Ryutaro Yamagata, Hyogo; Nobuhiko Kozuka, Osaka; Hitoshi Nishihama, Osaka; Shigeo Koyama, Osaka; Kazutada Sakai, Osaka, all of Japan

[73] Assignee: Mita Industrial Company Limited, Osaka, Japan

[21] Appl. No.: 265,565

[22] Filed: May 20, 1981 (Under 37 CFR 1.47)

[51] Int. Cl.[3] ..... G03G 21/00

[52] U.S. Cl. ..... 355/15; 355/3 DD; 15/256.52

[58] Field of Search ..... 355/15, 3 R, 3 DD; 15/1.5, 256.52

[56] References Cited

U.S. PATENT DOCUMENTS

| | | | |
|---|---|---|---|
| 3,615,813 | 10/1971 | Clarke et al. | 355/15 X |
| 3,620,617 | 11/1971 | Kelly | 355/3 |
| 4,011,835 | 3/1977 | Lewis | 355/3 DD |
| 4,032,225 | 6/1977 | Williams | 355/3 DD |
| 4,054,381 | 10/1977 | Bernhard | 355/3 DD |
| 4,095,881 | 6/1978 | Maddox | 355/71 X |
| 4,218,134 | 8/1980 | Kamiya et al. | 355/71 |
| 4,361,922 | 12/1982 | Karal | 355/15 X |

*Primary Examiner*—Richard L. Moses

*Attorney, Agent, or Firm*—Wenderoth, Lind & Ponack

[57] ABSTRACT

A cleaning device for use on a transfer type electrostatic copying apparatus includes a magnetic brush cleaning device for cleaning off a magnetizable toner remaining on a photosensitive material after a transfer operation. A brush roller is disposed between the magnetic brush cleaning device and a transfer zone. A brush is arranged on a peripheral surface of a cylindrical sleeve of light transmitting material and is driven for rotation in contact with the photosensitive material. A charge eraser lamp is secured within the cylindrical sleeve. The charge on the photosensitive material or photoreceptor is almost completely erased, and consequently, the cleaning efficiency is markedly improved owing to the facilitated removal of the developing material by the magnetic brush.

8 Claims, 15 Drawing Figures

CLEANING DEVICE FOR USE ON AN ELECTROSTATIC COPYING APPARATUS

BACKGROUND OF THE INVENTION

1. Field of the Invention

The present invention generally relates to a transfer type electrostatic copying apparatus, and more particularly, to a cleaning device which cleans off developing material remaining on a photosensitive material or photoreceptor by means of a magnetic brush.

2. Description of the Prior Art

Conventionally, in a known cleaning device of the above described type in which cleaning is effected by the use of a magnetic brush, since the developing material remaining on the photoreceptor is strongly attracted onto the surface of the photoreceptor, it is difficult to remove such developing material by the magnetic brush. Therefore, it has been practice to effect an operation to weaken the adhesion of the developing material by a charge erasing lamp or the like before the cleaning by the magnetic brush. However, the conventional arrangement as described above has such a disadvantage that, since the portions from which the charge is to be erased are located behind the remaining developing material, the cleaning efficiency has been undesirably low.

Accordingly, it is a primary object of the present invention to provide a cleaning device for use in an electrostatic copying apparatus in which cleaning efficiency by the magnetic brush is improved by solving the technical problems described above.

It is another object of the invention to provide a cleaning device which is arranged to feed the developing material removed by the magnetic brush positively into a developing material receptacle container.

It is still another object of the invention to provide an overflow detection device for use in detecting that a developing material receptacle container has been filled up with removed developing material.

SUMMARY OF THE INVENTION

To accomplish the foregoing objectives, there is provided a cleaning device for a transfer type electrostatic copying apparatus which comprises magnetic brush cleaning means for cleaning off a magnetizable toner remaining on a photosensitive material after a transfer operation. A brush roller is disposed between the magnetic brush cleaning means and a transfer zone, and is formed by a brush arranged on a peripheral surface of a cylindrical mamber of light transmitting material and driven for rotation in contact with the photosensitive material. A charge eraser lamp is secured within the cylindrical member.

The brush is arranged on the peripheral surface of the cylindrical member to form a light transmitting portion allowing light from the charge eraser lamp to pass onto the photosensitive material. The brush roller is driven to rotate with respect to the photosensitive material at such a rotational speed that possible damage to the surface of the photosensitive material, or scattering of the remaining developing material over the photosensitive material is advantageously prevented. The cylindrical member is made of a material capable of cutting off light having a wavelength adversely affecting the photosensitive material. The brush is made of a electrically conductive material.

According to the foregoing arrangement, since the developing material remaining on the photosensitive material or photoreceptor is deviated or shifted in position by the brush roller before the cleaning process by the magnetic brush, while the portions from which the developing material has been removed by such shifting are subjected to the light projection by the charge eraser lamp for erasing the charge thereat, the charge on the photoreceptor is almost completely erased, and consequently, the cleaning efficiency is markedly improved owing to the facilitated removal of the developing material through cleaning by the magnetic brush.

The magnetizable developing material remaining on the photosensitive material is cleaned off by a magnetic brush, the bristle length of which is restricted by means of a restricting member. The invention further includes a rotary shaft disposed upstream of the restricting member with respect to the direction of rotation of the magnetic brush and driven to rotate around an axis parallel with a rotational axial line of the magnetic brush. A transporting member formed of non-magnetic material for transporting developing material restricted by the restricting member is secured to the rotary shaft to rotate therewith. A developing material receptacle for receiving the developing material from the transporting member when the transporting member rotates has an opening facing upwardly on a side of the rotary shaft opposite the magnetic brush. The developing material removed by the magnetic brush is transported by the transport member to a position above the developing material receptacle container, and therefore, the removed developing material can be positively fed into the developing material receptacle container.

There are further provided a switching means for alternating a switching mode in accordance with the weight of the developing material stored in the developing material receptables i.e., when the weight has reached a predetermined value. Since the state of switching is altered by the weight of developing material when the developing material accumulated in the developing material receptacle container has reached a preliminarily set weight, it is readily detected that the developing material receptacle container has been filled up by the developing material, and overflowing of the developing material from the developing material receptacle container may be advantageously prevented.

BRIEF DESCRIPTION OF THE DRAWINGS

A detailed description of the invention will be made with reference to the accompanying drawings, wherein like numerals designate corresponding parts in the several figures, and wherein.

DETAILED DESCRIPTION OF THE PREFERRED EMBODIMENTS

Figure 1:
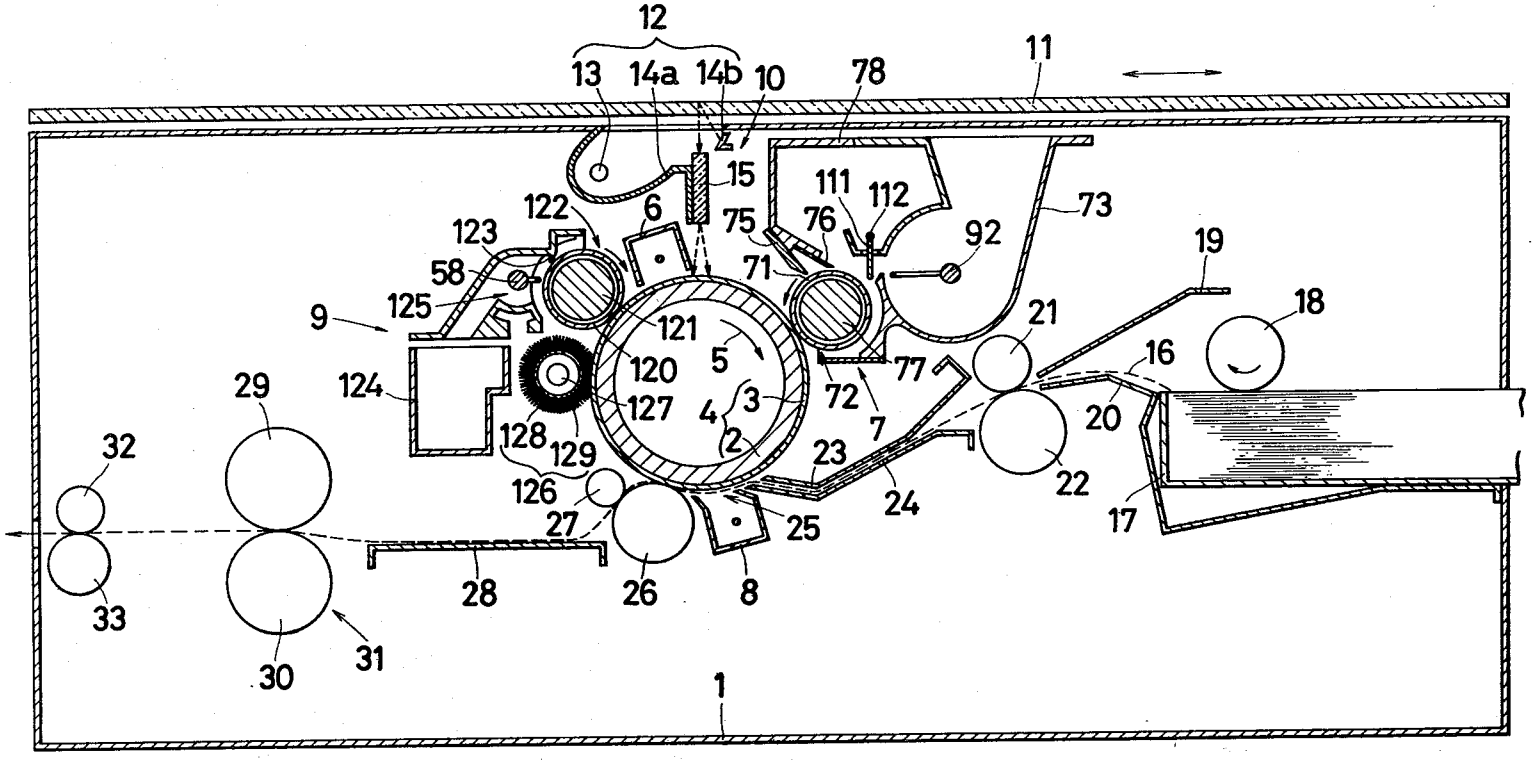
FIG. 1 is a simplified side sectional view of an electrostatic copying apparatus according to the invention.

Referring now to the drawings, there is shown in FIG. 1 a schematic side sectional view of a transfer type electrostatic copying machine according to one preferred embodiment of the invention. The copying apparatus of FIG. 1 includes a photosensitive or photoreceptor drum 4 having a photosensitive material or photoreceptor 3 provided on the entire peripheral surface of a drum 2, and rotatably mounted at approximately a central portion of a machine housing 1. Around the photoreceptor drum 4, there are sequentially disposed, along the rotational direction indicated by the arrow 5, a charging corona discharger 6 for preliminarily charging the photoreceptor 3, a developing device 7 for visualizing an electrostatic latent image formed on the photoreceptor 3 into a visible toner image, a transfer corona discharger 8 for transferring the toner image thus formed on the photoreceptor 3 onto a copy paper sheet, and a cleaning device 9 for cleaning off the toner remaining on the photoreceptor 3 after the transfer process.

Above the photoreceptor drum 4, there is provided an exposure device 10 for projecting a light-wise image of an original to be copied (not shown) onto the photoreceptor 3 in a position between the charging corona discharger 6 and the developing device 7, as shown by the dotted arrows. At the upper portion of the machine housing 1, an original carrier 11 is provided on which the original to be copied is horizontally placed for reciprocating movement as indicated by the double-headed arrows. In the exposure device 10, a light projecting means 12 for projecting light onto the original through the original carrier 11 further includes an exposure lamp 13, a reflector plate 14*a* and an auxiliary reflector plate 14*b*. The light projected towards the original placed on the original carrier 11 is focussed onto the photoreceptor 3 through a single focal point lens 15 to form the image of the original thereon, and thus, the electrostatic latent image is formed on the photoreceptor 3.

Along a copy paper transport passage 16 shown by a dotted line, the copy paper sheets stacked and accommodated in a paper feeding cassette 17 are fed, one sheet by one sheet, by a paper feeding roller 18 from the paper feeding cassette 17. The copy paper sheets are transported by a pair of feeding and transporting rollers 21 and 22 through upper and lower guide plates 19 and 20. A copy paper sheet fed into a transfer region 25 through another pair of upper and lower guide plates 23 and 24 is caused to closely adhere to the surface of the photoreceptor drum 4 confronting the transfer corona charger 8. After the transfer process, the copy paper sheet is held, at one edge thereof in the direction of the width thereof, between a separating roller 26 and an auxiliary separating roller 27 so as to be peeled off the surface of the photoreceptor drum 4, and is fed into a heat fixing device 31 having a pair of heat fixing rollers 29 and 30 through a guide plate 28. In heat fixing device 31, the toner image on the surface of the copy paper sheet is fixed. After the fixing process as described above, the copy paper sheet is discharged onto a copy paper tray (not shown) through a pair of discharging rollers 32 and 33.

Figure 2:
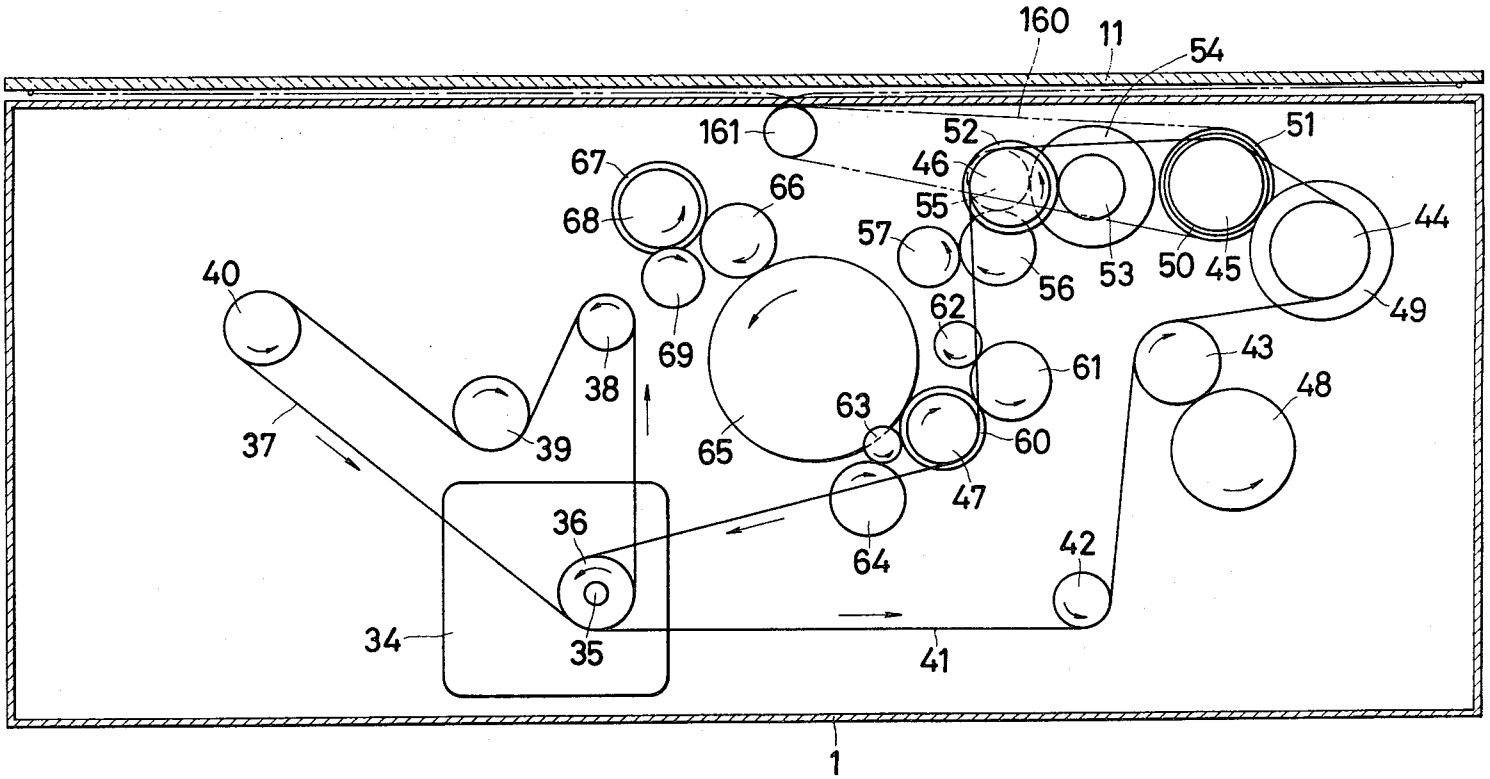
FIG. 2 is a schematic side sectional view of the copying apparatus of FIG. 1 as viewed from the reverse side thereof for illustrating its driving system.

Referring also to FIG. 2 showing a schematic side sectional view of the copying machine of FIG. 1 as viewed from the reverse side thereof for illustrating its driving system, to an output shaft 35 of a motor 34, there is secured a sprocket wheel 36, around which a first endless chain 37 is directed or passed. The chain 37 is sequentially passed around a sprocket wheel 38, a sprocket wheel 39 coupled to the feeding and transporting roller 22 and a sprocket wheel 40 connected to the copy paper feeding roller 18 along its running direction indicated by an arrow. Meanwhile, around another sprocket wheel (not shown) secured to the output shaft 35 so as to be one unit with the sprocket wheel 36, a second endless chain 41 is passed. The chain 41 is sequentially passed around sprocket wheels 42 and 43, two sprocket wheels 44 and 45 for driving the original carrier 11, and sprocket wheels 46 and 47 along its running direction indicated by an arrow. A gear (not shown) to be rotated as one unit with the sprocket wheel 43 is engaged with a gear 48 connected to the heat fixing roller 29. The sprocket wheel 44 is connected to a gear 49 through a clutch which is not shown, while the sprocket wheel 45 is coupled to a gear 50 and a pulley 51 through a clutch which is not shown, with the gears 49 and 50 being in mesh with each other. A cable or wire 160 connected at one end thereof to the right side end of the original carrier 11 as shown in FIG. 2 is further passed around pulley 51 from a pulley 161, and again around the pulley 161 and is connected at its other end to the left side end of the original carrier 11 in FIG. 2. By the changeover of a clutch (not shown), the pulley 51 is subjected to forward or reverse rotation, according to which the original carrier 11 is reciprocated in the directions shown by the double-headed arrow in FIG. 1. By the functions of the two clutches as described above, when the original carrier 11 is driven by the driving force from the sprocket wheel 44, original carrier 11 is caused to run at a comparatively high speed, while when the original carrier 11 is driven by the driving force from the sprocket wheel 45, it is caused to move at a comparatively low speed.

A gear 52 mounted on the same shaft as the sprocket wheel 46 is connected to a gear 57 through gears 53, 54, 55 and 56. The gear 56 is secured to a rotary shaft 58 of the cleaning device 9, while the gear 57 is concentrically fixed to a sleeve 120 of the cleaning device 9. A gear 60 to be rotated as one unit which the sprocket wheel 47 is connected through a gear 61 to a gear 62 which is coupled to a cylindrical member 128 of the cleaning device 9. Meanwhile, the gear 60 is connected to gear 64 associated with the separating roller 26 through a gear 63. Furthermore, the gear 60 is connected to a gear 65 which is integral with the photoreceptor drum 4, while the gear 65 is engaged with a gear 69 through gears 66, 67 and 68, with the gear 69 being connected to a developing sleeve 71 of the developing device 7.

Figure 3:
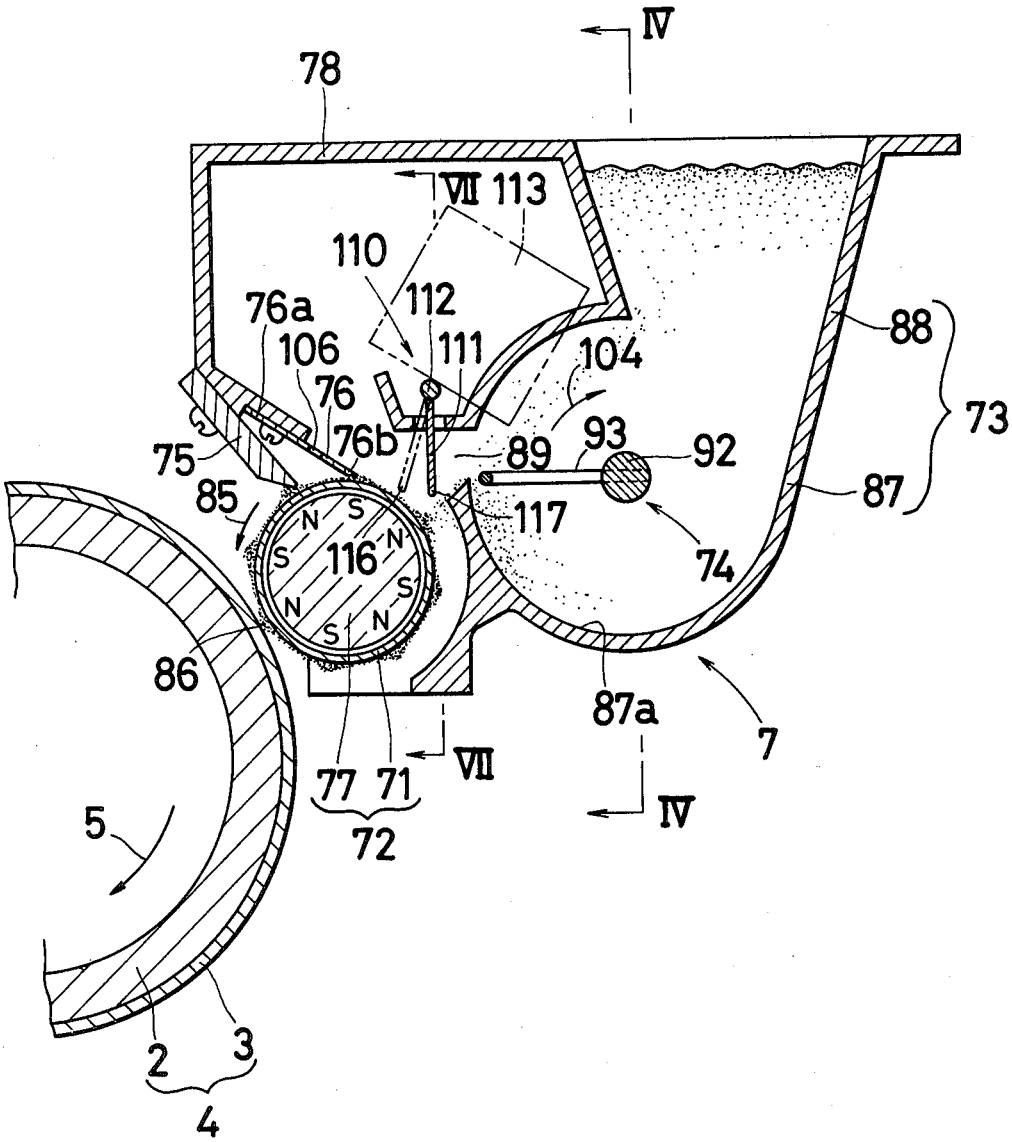
FIG. 3 is a fragmentary cross sectional view showing, on an enlarged scale, the arrangement in the vicinity of a developing device employed in the copying apparatus of FIG. 1.

Referring further to FIG. 3 showing on an enlarged scale from the front side, the arrangement in the vicinity of the developing device 7 in FIG. 1, the developing device 7 further includes a developing roller 72 disposed in the vicinity of the photoreceptor 3 in a direction parallel with the axis of the photoreceptor drum 4, a storage container 73 for storing therein a mono-component magnetizable toner, as a developing material, a stirring and feeding means 74 operably housed in the storage container 73 for stirring the mono-component magnetizable toner therein and also for supplying the mono-component magnetizable toner onto the developing roller 72, a bristle cutting member 75 for restricting the length of the magnetic brush bristles to be formed on the peripheral surface of the developing roller 72, and a blade member 76 for once separating the magnetic brush from the peripheral surface of the developing roller 72 so as to bring it towards the bristle cutting member 75.

Figure 4:
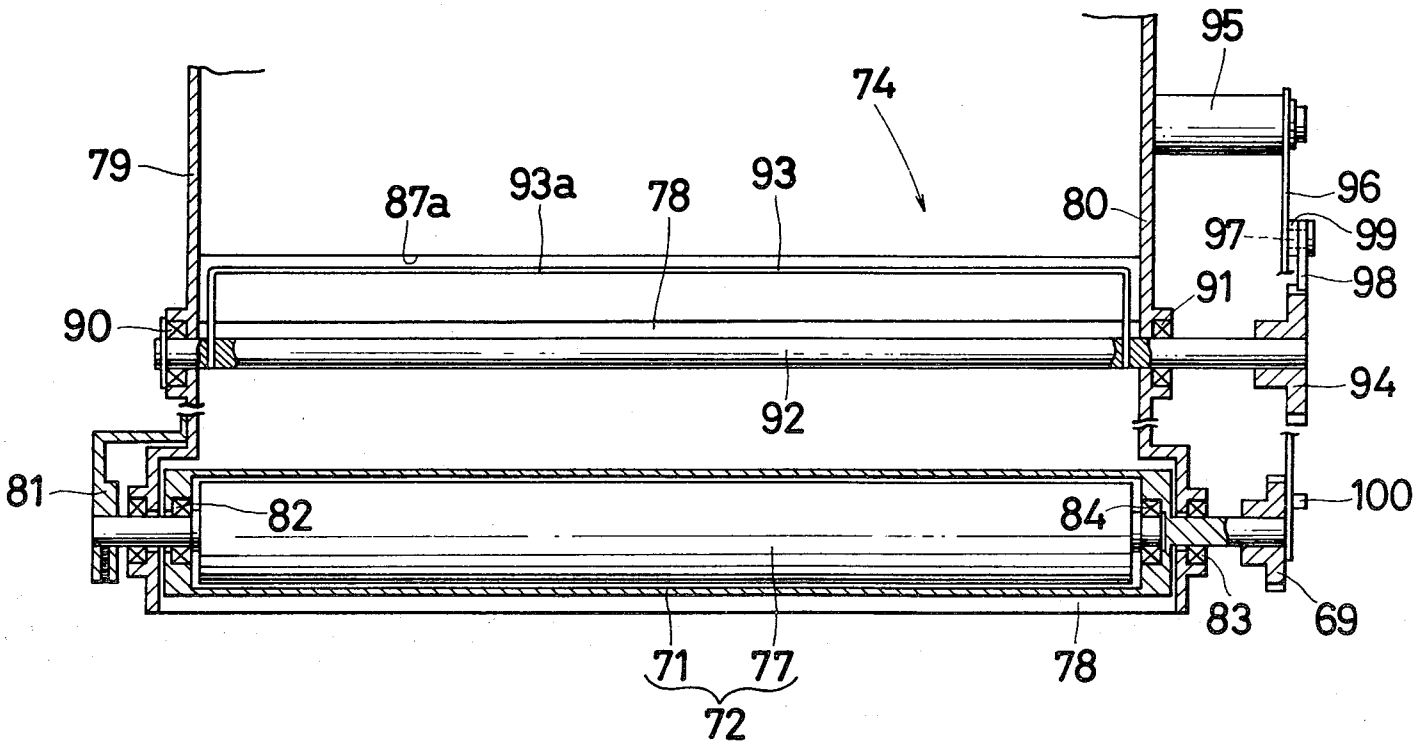
FIG. 4 is a schematic cross sectional view taken along the line IV—IV of FIG. 3.

Reference is also made to FIG. 4 showing a simplified cross section taken along the line IV—IV of FIG. 3. The developing roller 72 has a permanent magnet member 77 concentrically secured in the hollow developing sleeve 71 made of non-magnetizable material. One end of the permanent magnet member 77 extends through a corresponding end of the developing sleeve 71 through a bearing 82, and is fixed to a support member 81 secured to a front side plate 79 of a frame 78 of the developing device 7. On the other hand, the other end of the developing sleeve 71 extends through a rear side plate 80 of the frame 78 through a bearing 83, and is fixed with the gear 69. The other end of the permanent magnet member 77 is supported by the developing sleeve 71 through a bearing 84. The permanent magnet member 77 is magnetized by a plurality of magnetic poles circumferentially spaced at equal intervals, with neighboring magnetic poles being directed to have alternately opposite polar orientation. As described with reference to FIG. 2, by the transmission of driving force to the gear 69, and consequent rotation of the developing sleeve 71 in the direction shown by the arrow 85 in FIG. 3, the mono-component magnetizable toner supplied from the storage container 73 forms a magnetic brush on the developing sleeve 71. At a developing position 86, the peripheral surface of the photoreceptor 3 is rubbed against the magnetic brush, whereby the electrostatic latent image on the photoreceptor 3 is developed into a visible image.

Figure 5:
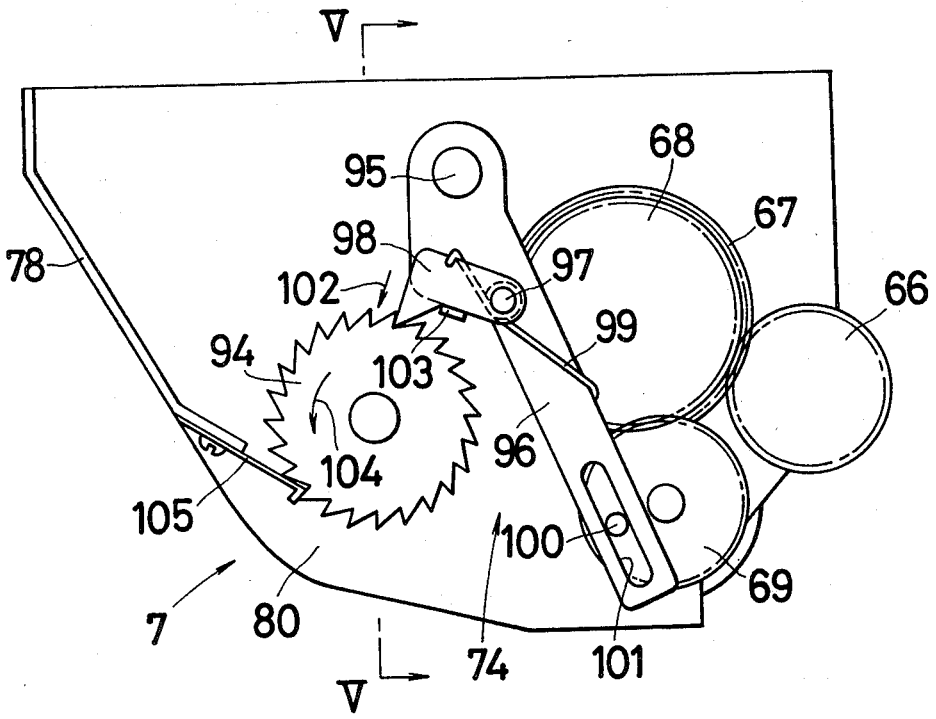
FIG. 5 is a schematic rear side view of the developing device of FIG. 3.

Referring to FIG. 3 and also to FIG. 5, showing a rear side view of the developing device 7, the storage container 73 includes an arcuate portion 87 having an arcuate shape in a vertical plane and extending in a direction parallel to the developing roller 72, and a conical portion 88 connected to the upper portion of the arcuate portion 87 at the side opposite to the developing roller 72 with respect to the central axis of the arcuate portion 87 and open upwardly as shown, and is formed into one unit with frame 78. At the side remote from the developing position 86 with respect to the developing roller 72, the arcuate portion 87 is formed with a supply port 89 for supplying the mono-component magnetizable toner onto the developing sleeve 72. The supply port 89 is defined above the developing roller 72 so that the mono-component magnetizable toner may be supplied onto the peripheral surface of the developing roller 72.

On the other hand, the stirring and supplying means 74 further includes a rotary shaft 92 journalled to the front and rear side plates 79 and 80 along the central axis of the arcuate portion 87 through bearings 90 and 91, a stirring and supplying member 93 integrally provided with the rotary shaft 92, a ratchet wheel 94 secured to one end of the rotary shaft 92, a rocking lever 96 pivotally supported at one end by a pin 95 provided on the rear side plate 80 and connected, at the other end thereof, to the gear 69 for rocking motion about pin 95 following rotation of the gear 69, a claw member 98 pivotally connected to an intermediate portion of the rocking lever 96 by a pin 97 for engagement with the teeth of the ratchet wheel 94, and a spring 99 which urges the claw member 98 towards the ratchet wheel 94.

The stirring and feeding member 93 extends parallel with and adjacent to an inner wall 87*a* of the arcuate portion 87 between the front and rear side walls 79 and 80, with its opposite end portions being bent at right angles so as to extend into and secured to the rotary shaft 92. At a position deviated from the axis of the gear 69, a pin 100 is provided, while an elongated opening 101 is formed at the other end of the rocking lever 96 for engagement with the pin 100. The spring 99 is provided to surround the pin 97, with one end of the spring 99 being engaged with the rocking lever 96 and the other end of spring 99 engaged with the claw member 98. By the spring force of spring 99, the claw member 98 is urged about the pin 97 in the direction shown by the arrow 102. The rocking lever 96 is provided with a stopper piece 103 for restricting the rotation of the claw member 98.

Through one rotation of the gear 69, i.e. by one rotation of the developing sleeve 71, the rocking lever 96 guided by the pin 100 engaged with the elongated opening 101 performs one reciprocating movement laterally as viewed in FIG. 5 about the pin 95, whereby the ratchet wheel 94 pushed by the claw member 98 connected to the rocking lever 96 is subjected to a angular displacement in the direction of the arrow 104. According to the angular displacement of the ratchet wheel 94, the rotary shaft 92 is also subjected to angular displacement by the same amount, with consequent angular displacement of the stirring and supplying member 93 integral with the rotary shaft 92. Therefore, the stirring and supply member 93 is rotated about the rotary shaft 92 following the rotational movement of the developing sleeve 71, whereby the mono-component magnetizable toner in the arcuate portion 87 is agitated, and is also brought to the supply port 89 by a longitudinal portion 93*a* of the stirring and supply member 93. The mono-component magnetizable toner thus brought to the supply port 89 is fed from supply port 89 onto the peripheral surface of the developing sleeve 71. By stirring the mono-component mgnetizable toner in the arcuate portion 87 through rotation of the stirring and supplying member 93, not only is blocking of the mono-component magnetizable toner within the storage container 73 prevented, but also a predetermined amount of the toner is always fed onto the peripheral surface of the developing sleeve 71 from the supply port 89. The number of revolutions of the stirring and supplying member 93 is so selected that the toner will not be absent on the peripheral surface of the developing sleeve 71, and in the embodiment described so far, it is arranged that the stirring and supplying member 93 completes one rotation, while the developing sleeve 71 makes 30 rotations, which may be achieved by suitably selecting the number of teeth of the ratchet wheel 94 and rocking distance of the claw member 98.

Additionally, for preventing reverse rotation of the ratchet wheel 94, there is fixed, on the frame 78, a reverse rotation preventing member 105, which is arranged to contact with the teeth of the ratchet wheel 94 at a position downstream side of the claw member 98 with respect to rotational direction 104.

Referring again to FIG. 3, in a position at the upstream side of the developing position 86 with respect to the rotational direction 85 of the developing sleeve 71, there is secured, to the frame 78, the bristle cutting member 75 closely confronting the peripheral surface of the developing sleeve 71. By bristle cutting member 75, the magnetic brush on the developing sleeve 71 is always restricted to have a predetermined bristle length as it is brought to the developing position 86. However at the upstream side immediately before the bristle cutting member 75, there may occur a situation where the mono-component magnetizable toner to be cut off by the bristle cutting member 75 is solidified, thus giving rise to the so-called blocking phenomenon, which takes place due to depression of the mono-component magnetizable toner moving over the developing sleeve 71 by the bristle cutting member 75. Such phenomenon tends to occur more frequently as the force of the depression increases, i.e. as the number of revolutions of the developing sleeve 71 increases. Upon occurrence of the blocking phenomenon as described above, the formation or the magnetic brush on the developing sleeve 71 is blocked by the mono-component magnetizable toner and thus is not fed to the developing position 86, thus making it impossible to effect developing thereat. Meanwhile, at the developing position 86, the base portion of the magnetic brush does not contribute to development, and remains on the peripheral surface of the developing sleeve 71 as it is so as to continue rotation together with the developing sleeve 71. Accordingly, the toner on the developing sleeve 71 has a lowered fluidity, with an alteration in the ability for formation of the brush bristles, and thus, the developing efficiency is correspondingly reduced.

Therefore, the blade member 76 is provided at the upstream side of the bristle cutting member 75 with respect to the rotational direction 85. The blade member 76 described above is so inclined as to be spaced from the developing sleeve 71 towards the downstream side along the rotational direction 85, with a base portion **76*a* being secured to the frame 78, and a free end 76*b* thereof is arranged to slide on the developing sleeve 71 over its entire length. It is to be noted here that, in the permanent magnet member 77, the position thereof corresponding to the bristle cutting member 75 and the position which is in sliding contact with the free end 76*b* of the blade member 76 are magnetized by adjacent magnetic poles having mutually different polar orientation. In this embodiment as shown in FIG. 3, the position corresponding to the bristle cutting member 75 is magnetized with an N pole, while the position corresponding to the blade member 76** is magnetized with an S pole.

Figure 6:
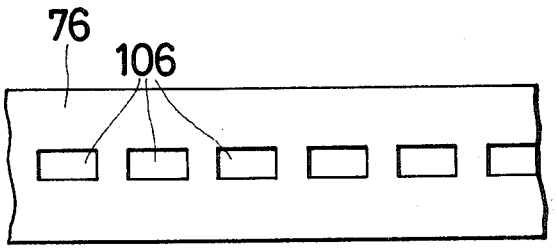
FIG. 6 is a fragmentary top plan view of a blade member.

In FIG. 6, showing the fragmentary top plan view of the blade member 76, a plurality of passing holes 106 are formed in the blade member 76 at a predetermined interval therebetween in the direction of the width of blade member 76 (i.e. in a direction perpendicular to the paper surface in FIG. 3). These passing holes 106 are each formed at a circumferential position approximately midway between the N pole (or S pole) corresponding to the position of bristle cutting member 75 and the S pole (or N pole) corresponding to the position of blade member 76.

On the assumption that the mono-component magnetizable toner attracted onto the developing sleeve 71 by the magnetic force of the permanent magnet member 77 is brought to the position of the blade member 76 following rotation of the developing sleeve 71, since the blade member 76 is in sliding contact with the developing sleeve 71, the mono-component magnetizable toner on the developing sleeve 71 is peeled off or scraped off therefrom. Furthermore, owing to the inclination of the blade member 76 in an upstream direction with respect to the rotational direction 85, the mono-component magnetizable toner thus scraped off advances over the blade member 76 up to the position of the passing holes 106. Since the passing holes 106 are each formed at approximately a position midway between the N pole and S pole as described earlier, the magnetic attracting force exerting on the mono-component magnetizable toner at the passing holes 106 is directed in a direction normal to the magnetic lines of force, i.e. in a direction radially inwardly of the developing sleeve 71. Accordingly, the toner is readily supplied towards the inner side of the radial direction of the developing sleeve 71 from the passing holes 106 through the above described magnetic attracting force.

In the manner as described above, by the action of the blade member 76, the mono-component magnetizable toner, after being once separated from the peripheral surface of the developing sleeve 71, is caused to fall through the passing holes 106 to be fed onto the developing sleeve 71, and therefore, the toner is always fluidized immediately before the bristle cutting member 75, with the possibility of the occurrence of undesirable blocking being advantageously prevented. Moreover, since the mono-component magnetizable toner on the developing sleeve 71 is loosened or softened by the blade member 76 at every rotation of the developing sleeve 71, the bristles of the magnetic brush at the developing position 86 are formed in the same state at all times, with consequent improvement on the developing efficiency.

Figure 7:
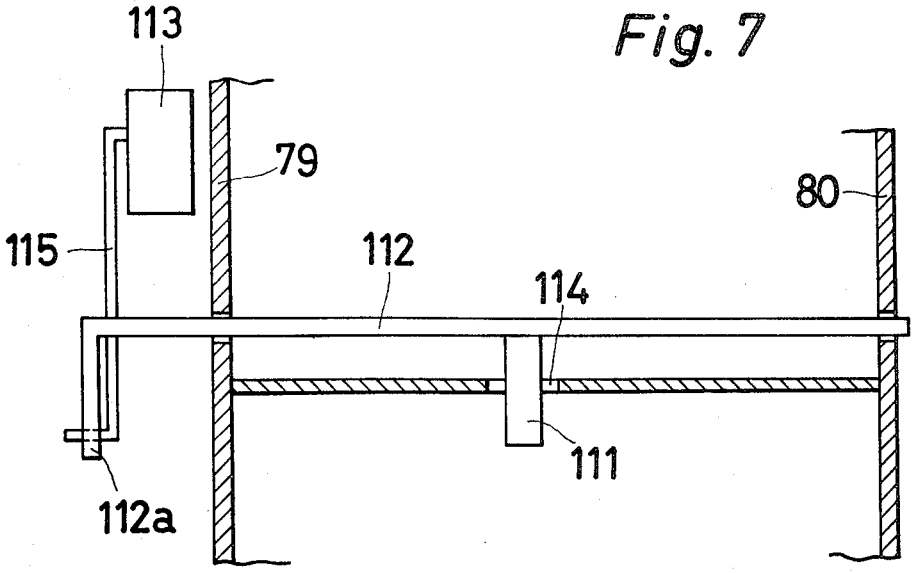
FIG. 7 is a schematic cross sectional view taken along the line VII—VII of FIG. 3.

Referring further to FIG. 7 showing a simplified cross section taken along the line VII—VII in FIG. 3, the developing apparatus 7 is provided with a detecting device 110 for detecting the presence of the toner (refer to both FIGS. 7 and 3). The detecting device 110 includes a detecting member 111 extending vertically between the supply port 89 of the storage container 73 and the developing roller 72, and pivotable in a plane at right angles with respect to the axis of the developing roller 72, an engaging member 112 extending in parallel relation with respect to the axis of the developing roller 72 and rotatably supported by the side plates 79 and 80, and a microswitch 113 as a switching means whose switched state is varied in response to the angular displacement of the engaging member 112.

The detecting member 111 extends vertically via a through-opening 114 defined in the frame 78 for restricting the range of angular displacement of detecting member 111, while the engaging member 112 is disposed above the through-opening 114. One end portion of the engaging member 112 is bent at a right angle at the outer side of the side plate 79, and the bent portion 112*a* thus formed is engaged with an actuator 115 of the microswitch 113, which is coupled, for example, to a toner replenishing instruction means such as a pilot lamp or the like (not shown).

On the assumption that the mono-component magnetizable toner is being supplied onto the developing roller 72 through the supply port 89 of the storage container 73, since the mono-component magnetizable toner is attracted onto the peripheral surface of the developing sleeve 71 of the developing roller 72 by the attracting force of the permanent magnet member 77, the detecting member 111 is rotated in a direction approaching the developing roller 72 through depression by the mono-component magnetizable toner as shown by the imaginary lines in FIG. 3. At such first angular displacement position 116 of the detecting member 111, the free end of the detecting member 111 is located approximately at a central position between an N pole and an S pole of the permanent magnetic member 77, whereby the detecting member 111 comes to be readily subjected to the angular displacement through a slight depressing force by the mono-component magnetizable toner. Following the angular displacement of the detecting member 111 to the first angular displacement position 116, the engaging member 112 is also subjected to the angular displacement, according to which the microswitch 113 is cut off. Accordingly, the pilot lamp as described earlier is kept de-energized at the first angular displacement position 116.

When the supply of the mono-component magnetizable toner from the supply port 89 of the storage container 73 is suspended, with further disappearance of the toner on the peripheral surface of the developing sleeve 71, the depressing force by the mono-component magnetizable toner is reduced, whereby the detecting member 111 is returned through rotation back to a second angular displacement position 117 shown by the solid lines in FIG. 3, by its own weight and the restoring force of the actuator 115 of the microswitch 113. By the angular displacement of the engaging member 112 following the rotational returning of the detecting member 111 to the second angular displacement position 117, the microswitch 113 is rendered conductive, with consequent illumination of the pilot lamp, and thus, it is indicated that the toner in the storage container 73 has been used up, with simultaneous absence of the toner on the peripheral surface of the developing sleeve 71.

It is to be noted here that the detecting member 111 and engaging member 112 should preferably be made to be light in weight as far as practicable so that they may be subjected to the angular displacement even by a slight depressing force of the toner.

Figure 8:
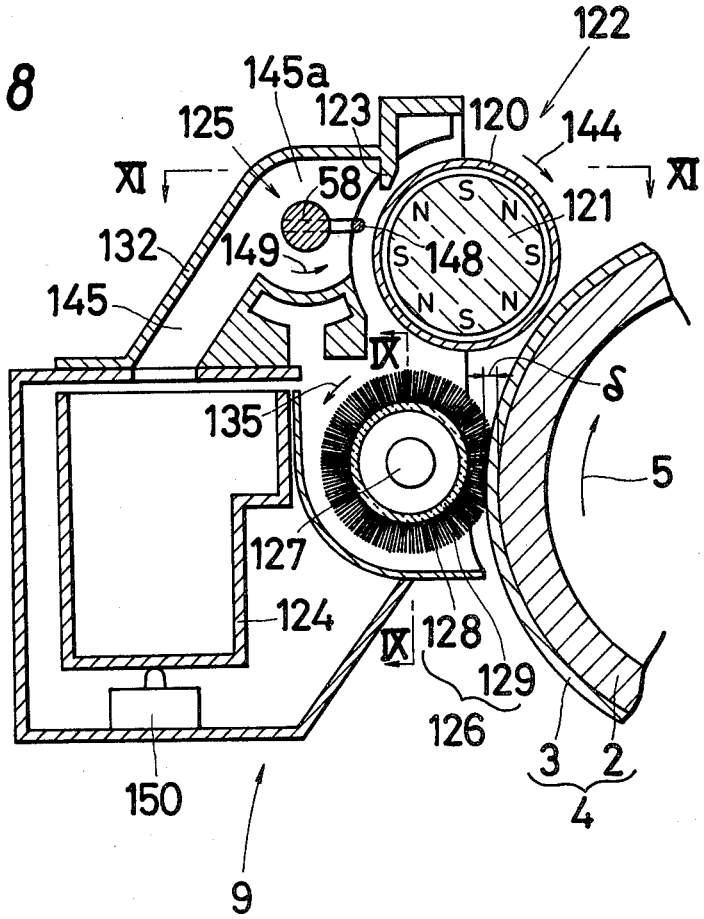
FIG. 8 is a fragmentary cross sectional view showing the arrangement in the vicinity of a cleaning device of FIG. 1.

Reference is also made to FIG. 8 showing, on an enlarged scale, a cross sectional view in the vicinity of the cleaning device 9. The cleaning device 9 generally includes a magnetic brush cleaning means 122 having a permanent magnet member 121 fixedly provided within a hollow sleeve 120 of non-magnetizable material which is driven for rotation, a restricting member 123 for restricting the bristle length of the magnetic brush to be formed on the peripheral surface of the sleeve 120, a toner receptacle 124 for receiving therein the toner removed by the magnetic brush cleaning means 122, a feed-in means 125 for forcibly feeding the remaining toner restricted by the restricting member 123 into the toner receptable 124, a brush roller 126 provided at the upstream side of the magnetic brush cleaning means 122 with respect to the rotational direction 5 of the photoreceptor drum 4, and a charge eraser lamp 127 provided within the brush roller 126.

Figure 9:
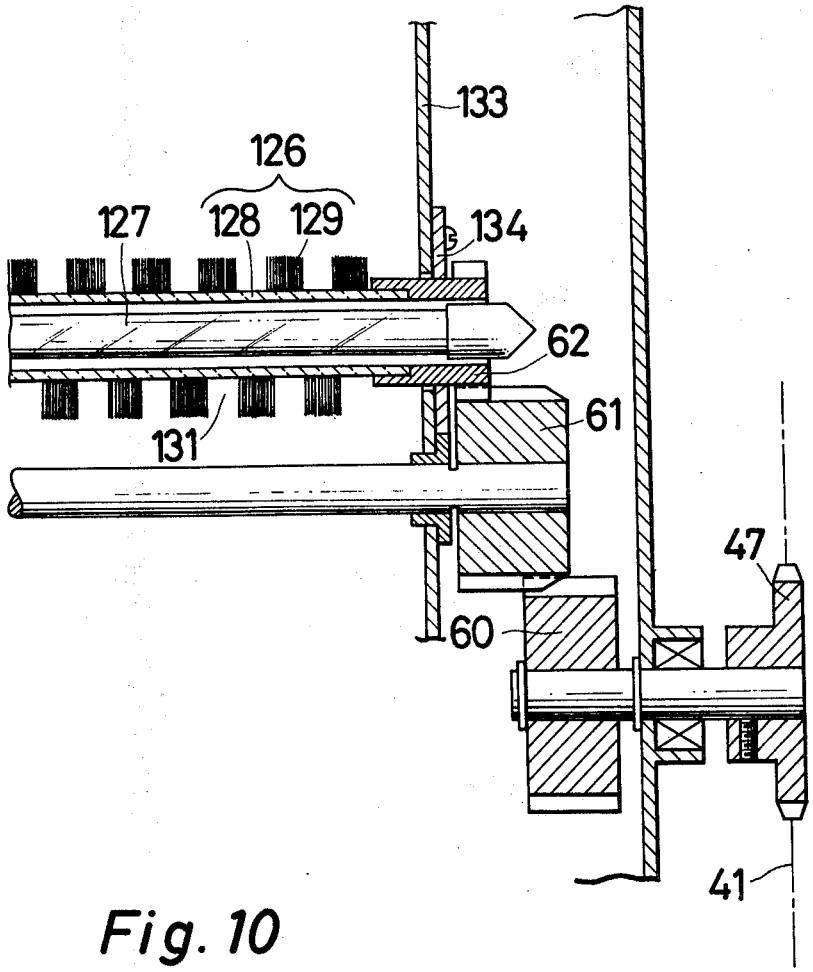
FIG. 9 is a fragmentary cross section taken along the line IX—IX of FIG. 8 showing the arrangement in the vicinity of a brush roller.
Figure 10:
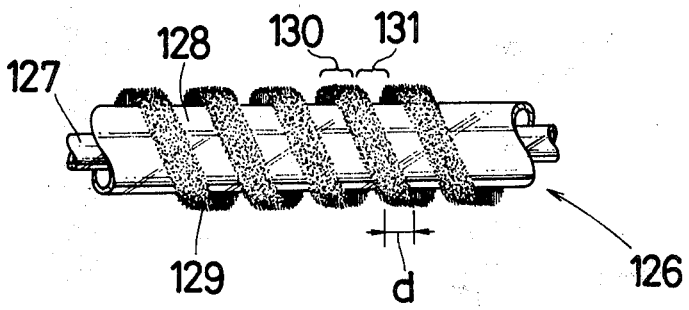
FIG. 10 is a fragmentary top plan view of the brush roller.

Referring further to FIG. 9 showing part of the arrangement in the vicinity of the brush roller 126 as viewed from the cross section taken along the line IX—IX of FIG. 8, the brush roller 126 is composed of a cylindrical member 128 of light transmitting material, for example, glass or the like, and a large number of brush bristles or brush hairs 129 of flexible material, for example, acrylic resin arranged on the outer peripheral surface of cylindrical member 128, and is disposed in a parallel relation with respect to the axis of the photoreceptor drum 4. As shown in FIG. 10, the brush bristles 129 are arranged on the outer peripheral surface of the cylindrical member 128 in a spiral configuration at a predetermined width d, with light transmitting portions 131 being formed between the neighboring bristle-filled portions 130 as shown. The length of the brush bristles 129 is so determined as to contact the peripheral surface of the photoreceptor drum 4 by a length $\delta$ from the free end of the bristles (FIG. 8). The length $\delta$ should suitably be in the region from 1 to 5 mm.

The opposite ends of the cylindrical member 128 are journalled by side plates 133 of a frame 132 of the cleaning device 9 through corresponding plain bearings 134. Within the cylindrical member 128, a charge eraser lamp 127 having a length longer than cylindrical member 128 is coaxially extended, while the opposite ends of the charge eraser lamp 127 are secured by supporting means (not shown). To the one end of the cylindrical member 128, there is secured the earlier described gear 62, which is engaged with the gear 60 mounted on the same shaft as the sprocket wheel 47 through the gear 61. By the driving force transmitted from the sprocket wheel 47, the cylindrical member 128 is driven for rotation in the direction of the arrow 135 in FIG. 8. The speed of rotation of the brush roller 126 is so selected that the peripheral speed at the portion contacting the surface of the photoreceptor drum 4 becomes larger by 0 to 500 m/H, and more preferably, by 100 to 300 m/H, than the peripheral speed of the photoreceptor drum 4. By selecting the rotational speed of the hair brush roller 126 as described above, possible damage to the surface of the photoreceptor 3 by the sliding contact of the brush roller 126 with the photoreceptor drum 4 or undesirable scattering of the mono-component magnetizable toner over the photoreceptor 3 may be advantageously prevented.

Furthermore, by rotating the brush roller 126 at the peripheral speed difference as described above, the position of the mono-component magnetizable toner remaining on the photoreceptor 3 is deviated or shifted in the circumferential direction by the brush roller 126, whereby, upon projection of light of the charge eraser lamp 127 onto the surface of the photoreceptor 3 through the light transmitting portions 131, the light is directed onto the portions of the photoreceptor 3 where the mono-component magnetizable toner is absent through the displacement, and the charge on such portion is erased. Thus, the cleaning by the magnetic brush cleaning means 122 at the downstream side of the brush roller 126 with respect to the rotational direction 5 of the photoreceptor drum 4 is effectively carried out.

It is to be noted here that by arranging flexible and electrically conductive fine carbon fibers on the outer peripheral surface of the cylindrical member 128, triboelectrical charging due to sliding contact between the brush 129 and photoreceptor 3 may be prevented. Meanwhile, it may be so arranged that a material capable of cutting off light having a wavelength adversely affecting the photoreceptor 3 is employed for the cylindrical member 128, whereby the cylindrical member 128 may also serve as a filter of the charge eraser lamp 127.

In the foregoing embodiment, since the brush 129 is spirally arranged on the cylindrical member 128, the amount of light projection by the charge eraser lamp 127 onto the photoreceptor 3 may be properly determined by suitably setting the intervals of the light transmitting portions 131, the number of revolutions of the brush roller 126, and contact length δ of the brush roller 126 with respect to the photoreceptor 3.

Figure 11:
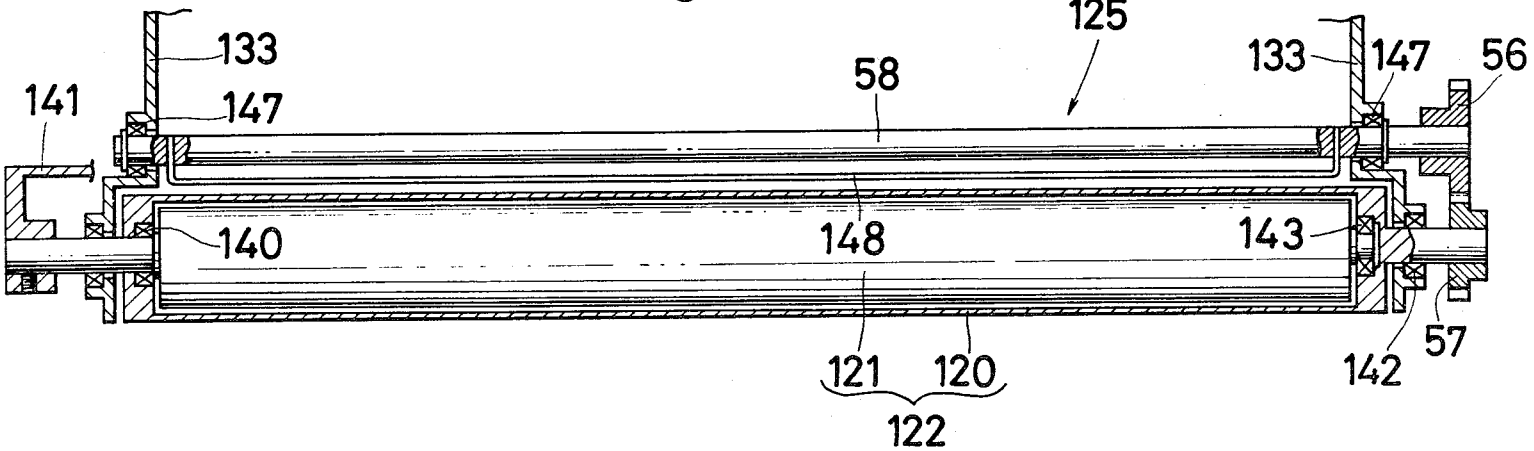
FIG. 11 is a schematic cross sectional view taken along the line XI—XI of FIG. 8.

Reference is also made to FIG. 11 showing a simplified cross section taken along the line XI—XI in FIG. 8, the magnetic brush cleaning means 122 is disposed at a position close to the photoreceptor 3 in a relation parallel to the axis of the photoreceptor drum 4. One end of the permanent magnet member 121 extending through one end of the sleeve 120 through a bearing 140 is secured to a support member 141 fixed to the side plate 133. Meanwhile, to the other end of the sleeve 120 which extends through the side plate 133 via a bearing 142 is fixed to the gear 57. The other end of the permanent magnet member 121 is supported by the sleeve 120 through a bearing 143. The permanent magnet member 121 is magnetized by magnetic poles equally spaced in the circumferential direction, with the neighboring magnetic poles directed to have alternately opposite polar orientation.

As described earlier with reference to FIG. 2, power is transmitted to the gear 57, whereby the sleeve 120 is rotated in the direction indicated by the arrow 144. (Refer to FIG. 8.) Accordingly, a magnetic brush having a bristle length determined by the restricting member 123 is formed so as to be in contact with the photoreceptor drum 4. As a result, the mono-component magnetizable toner remaining on the photoreceptor 3 is attracted onto the sleeve 120 through the magnetic attracting force of the permanent magnet member 121, and thus, is removed from the surface of the photoreceptor 3.

As was explained with reference to FIGS. 9 and 10, the toner remaining on the photoreceptor 3 is displaced over the peripheral surface of the photoreceptor 3 through action of the brush roller 126, while the charge on the entire peripheral surface of the photoreceptor 3 is erased, since the light from the charge eraser lamp 127 is projected thereonto through the light transmitting portions 131. Therefore, in the magnetic brush cleaning means 122, the toner on the photoreceptor 3 is readily attracted onto the sleeve 120, with a further improvement of the cleaning efficiency by the magnetic brush cleaning means 122.

Referring back to FIG. 8, in the magnetic brush cleaning means 122, at the side remote from the photoreceptor drum 4, the restricting member 123 is fixed to the frame 132 in a position close to the peripheral surface of the sleeve 120. By this restricting member 123, the bristle length of the magnetic brush on the sleeve 120 is restricted, while the feed-in means 125 is provided for feeding the surplus toner thus restricted into the toner receptacle 124. Still with reference to the magnetic brush cleaning means 122, at the side remote from the photoreceptor drum 4 and at a position lower than that of the magnetic brush cleaning means 122, the toner receptacle 124 is open at its upper portion, and between the magnetic brush cleaning means 122 and the toner receptacle 124, there is formed a passage 145 for feeding-in the toner. The toner feed-in means 125 is provided at the upstream side of the restricting member 123 with respect to the rotational direction 144 of the sleeve 120 at an opening 145*a* of the passage 145 at the side of the cleaning means 122. Referring again to FIG. 11, the feed-in means 125 includes the rotary shaft 58 supported, at opposite ends thereof, by the corresponding side plates 133 through bearings 147, and a toner transport member 148 of non-magnetizable material provided as one unit with the rotary shaft 58. To the rotary shaft 58, the gear 56 is fixedly mounted, and by the driving force to be transmitted to the gear 56, the rotary shaft 58 is rotated in the direction indicated by the arrow 149. (Refer to FIG. 8.) The toner transport member 148 is arranged to extend in a relation parallel to the rotary shaft 58, with opposite ends thereof bent at right angles and secured to the rotary shaft 58. The rotational direction 149 of the rotary shaft 58 is selected to be opposite to that of the sleeve 120, whereby the surplus mono-component magnetizable toner restricted by the restricting member 123 is transported by the toner transport member 148 so as to be positively brought into the passage 145. The mono-component magnetizable toner thus fed into the passage 145 falls in the passage 145 by its own weight into the toner receptacle 124.

Still referring to FIG. 8, the toner receptacle 124 is placed on a microswitch 150 as a switching means, which is set to be rendered conductive when the mono-component toner to be accommodated in the toner receptacle 124 reaches a predetermined weight. The microswitch 150 as described above is connected to a toner collection indicating means such as a pilot lamp or the like, and is arranged to illuminate the pilot lamp when the weight of the mono-component magnetizable toner within the toner receptacle 124 has reached a predetermined level. Accordingly, it is readily detected when the toner receptacle 124 has been filled with the mono-component magnetizable toner.

Figure 12:
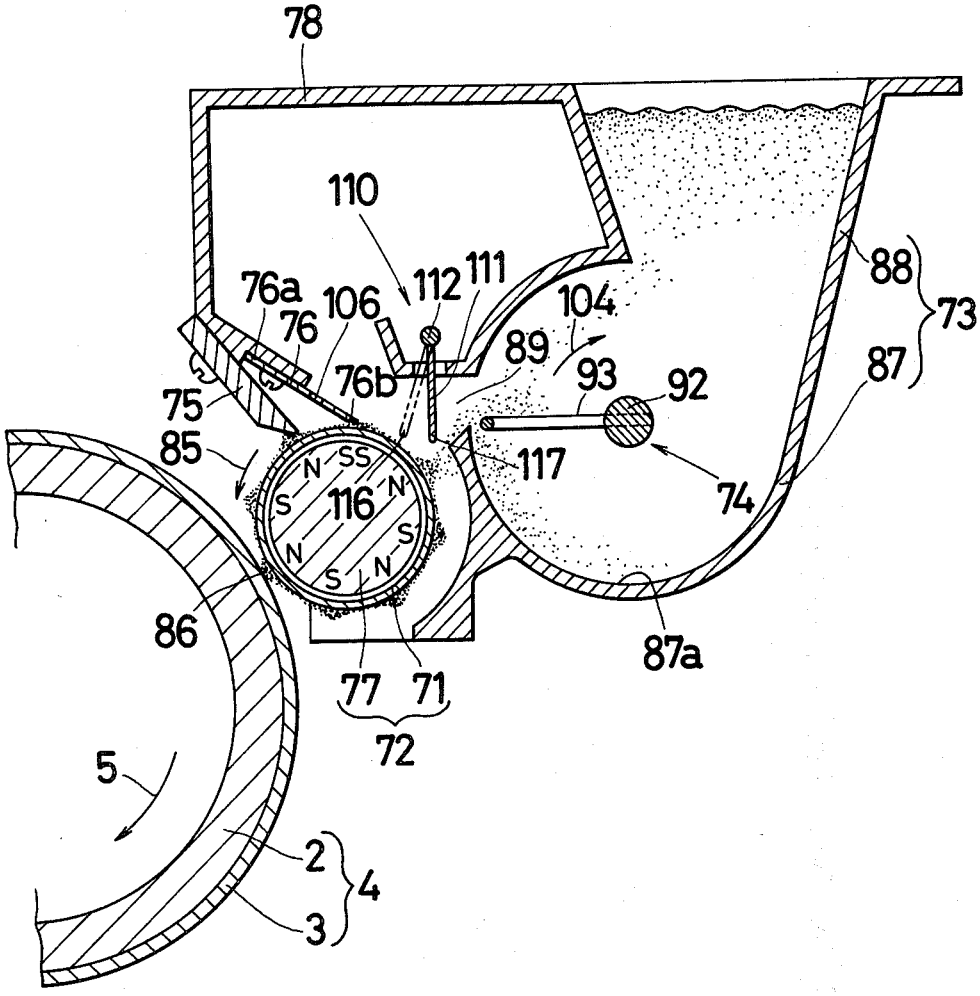
FIG. 12 is a cross sectional view showing the developing device according to another aspect of the invention.

Reference is made to FIG. 12 showing a cross sectional view of a developing apparatus according to another embodiment of the present invention, by which the developing apparatus 7 of the embodiment of FIGS. 1 through 11 may be replaced.

In the embodiment of FIG. 12, the permanent magnet member 77 is magnetized by a pair of magnetic poles (S poles in this embodiment) having the same polarity in a position corresponding to the position of sliding contact of the blade member 76 with the developing sleeve 71. By experiments carried out by the present inventors, a remarkable effect has been obtained when the magnetic poles are disposed at intervals of 2 to 6 mm around the circumferential surface of the permanent magnet member 77. Meanwhile, in a position corresponding to the bristle cutting member 75, the magnet member 77 is magnetized by a magnetic pole adjacent the pair of magnetic poles (S poles in this embodiment) and has a polarity opposite thereto (N pole in this embodiment). Since the other constructions of the developing device of FIG. 12 are generally similar to those of the arrangement of FIG. 3, detailed description thereof is omitted here for the sake of brevity.

By magnetizing the permanent magnet member 77 with the pair of magnetic poles of the same polarity at the position for sliding contact of the blade member 76, the attracting force for attracting the mono-component magnetizable toner onto the developing sleeve 71 at the sliding contact position of the blade member 76 is weakened. Moreover, since the magnetic lines of force from the magnetic poles of the same polarity are directed in the radial direction of the developing sleeve 71, the mono-component magnetizable toner is subjected to the magnetic attracting force in the tangential direction of the developing sleeve 71. Therefore, the mono-component magnetizable toner on the developing sleeve 71 is separated from the surface of the developing sleeve 71 at a position before the sliding contact position of the blade member 76, and jumps over the sliding contact position to be transferred to the blade member 76, and thus, reaches the passing holes 106. Accordingly, in the above arrangement, it is not necessary to cause the blade member 76 to strongly contact the sleeve 71, and therefore, undesirable blocking of the toner by the blade member 76 can be prevented.

Figure 13:
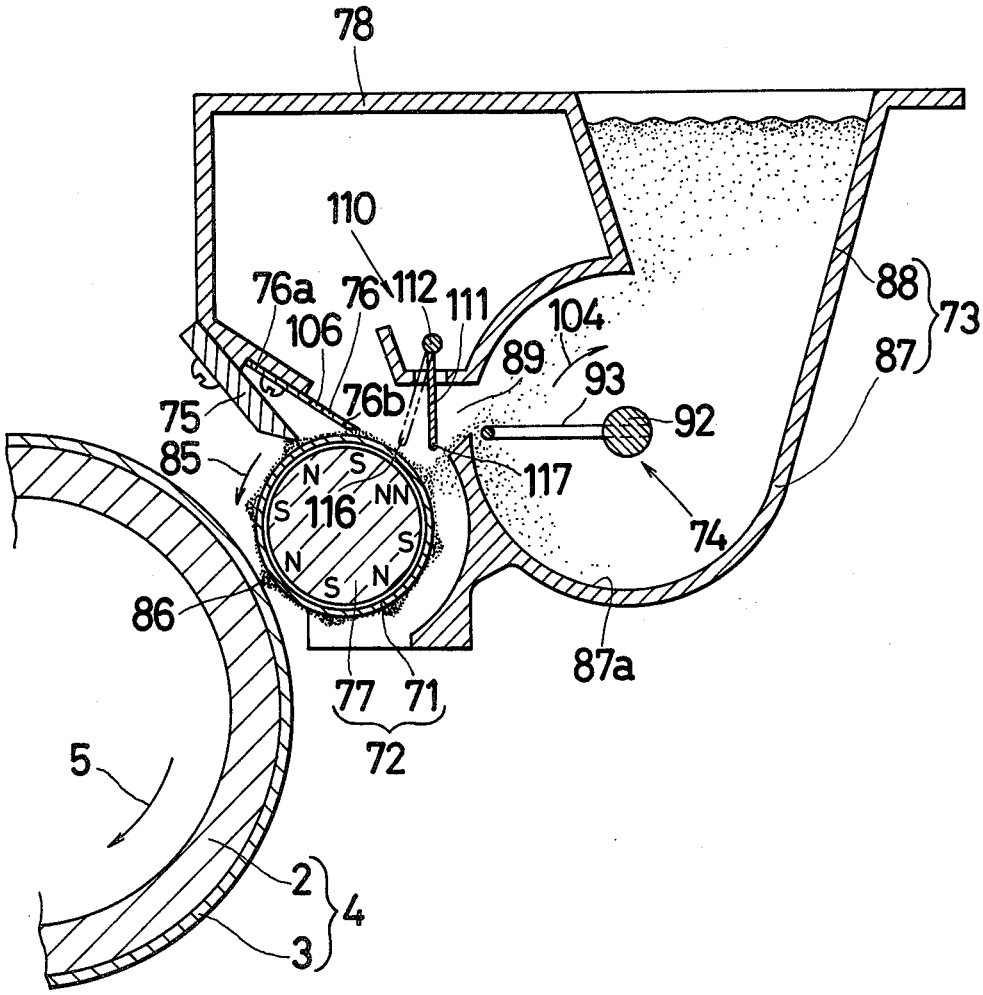
FIG. 13 is a cross sectional view showing the developing device according to still another aspect of the invention.

Referring to FIG. 13, there is shown, on an enlarged scale, a cross section of a developing apparatus according to a further embodiment of the invention, in which like parts corresponding to those in FIG. 3 are designated by like reference numerals.

In the embodiment of FIG. 13, the permanent magnet member 77 is magnetized by a pair of magnetic poles having the same polarity (N poles in this embodiment) located in the peripheral area or range from the developing position 86 to the blade member 76 along the rotational direction 85 of the developing sleeve 71. These magnetic poles are arranged, for example, at intervals of 2 to 6 mm around the circumferential surface of the permanent magnet member 77. Since other constructions are generally similar to those of the arrangement of FIG. 3, detailed description thereof is also omitted here for the sake of brevity.

By the arrangement of FIG. 13 as described above, the mono-component magnetizable toner of the magnetic brush formed on the surface of the developing sleeve 71 not contributing to developing, and rotated together with the developing sleeve 71 from the developing position 86 is temporarily displaced when it passes the position at which the pair of magnetic poles of the same polarity are disposed close to each other. The above displacement takes place because, in the region between the developing position 86 and the position at which the pair of magnetic poles of the same polarity are disposed, the regular variation of the formation and structure of the magnetic brush due to the alternate arrangement of the N poles and S poles is interrupted and shifted and caused to be out of phase. Accordingly, since the mono-component magnetizable toner whose magnetizing function is thus weakened is transported up to the position of the blade member 76, the toner may be easily peeled off or scraped off from the peripheral surface of the developing sleeve 71.

It should be noted that the position at which the pair of magnetic poles of the same polarity close to each other are to be magnetized is not limited to be one position as described in the above arrangement of FIG. 13, but may be further modified to be provided at a plurality of spots in the peripheral area from the developing position 86 to the blade member 76 along the rotational direction 85.

Figure 14:
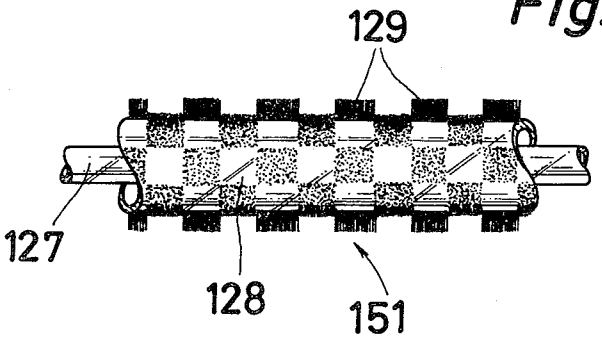
FIG. 14 is a fragmentary top plan view showing a brush roller according to still further aspect of the invention.

Referring to FIG. 14, there is shown a top plan view of a modified brush roller 151 according to the present invention, which may replace the brush roller 126 in the embodiment of FIGS. 1 through 11. As shown in FIG. 14, the modified brush roller 151 may be formed by arranging the brush 129 on the peripheral surface of the cylindrical member 128 in a lattice-like or checkerboard pattern.

Figure 15:
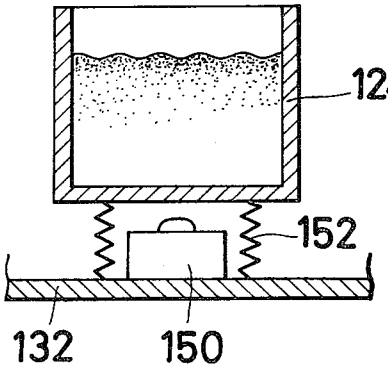
FIG. 15 is a fragmentary cross sectional view showing the arrangement of a toner receptacle according to another aspect of the invention.

Reference is further made to FIG. 15 showing a cross section of an arrangement for the toner receptacle according to a still further embodiment of the present invention. As shown in the arrangement of FIG. 15, the toner receptacle 124 may be so arranged as to be placed on the frame 132 through a spring 152 so that, when the spring 152 is compressed by the weight of the mono-component magnetizable toner accumulated within the toner receptacle 124 and the amount of the mono-component magnetizable toner has reached a predetermined value, the microswitch 150 is rendered to be conductive, by which arrangement the detection weight can be adjusted by the adjustment of the spring force of the spring 152.

What is claimed is:

1. A cleaning device for use in a transfer type electrostatic copying apparatus for removing residual magnetizable toner from a photosensitive surface of the copying apparatus after an operation of transfer of an electrostatic latent toner image from the photosensitive surface, said cleaning device comprising:

magnetic brush cleaning means, adapted to be positioned adjacent the photosensitive surface at a downstream position with respect to the position of a transfer operation, for magnetically removing residual toner from the photosensitive surface, said magnetic brush cleaning means comprising a permanent magnet member fixedly positioned within a hollow sleeve which is formed of a non-magnetizable material and which is rotatable adjacent the photosensitive surface, such that there is formed on the peripheral surface of said sleeve a magnetic brush of toner removed from the photosensitive surface;

a restricting member positioned adjacent said sleeve for restricting the length of the bristles of said magnetic brush formed on said peripheral surface;

a toner receptacle for receiving toner removed from the photosensitive surface by said magnetic brush cleaning means, said receptacle being mounted for downward movement as the weight of toner accumulated in said receptacle increases;

switch means positioned with respect to said receptacle to be actuated thereby when the weight of toner accumulated therein has reached a predetermined value and thereby to provide an indication of such accumulation;

feed-in means for forcibly feeding said removed toner to said receptacle means; and brush roller means, adapted to be positioned upstream of said magnetic brush cleaning means, for removing a charge from the photosensitive surface prior to removal therefrom of the residual toner by said magnetic brush cleaning means, said brush roller means comprising a cylindrical member formed of a light transmitting material and mounted for rotation, a charge eraser lamp positioned within said cylindrical member, and a brush arranged on the peripheral surface of said cylindrical member to brush against the photosensitive surface, said brush being arranged on said peripheral surface in a manner to define light transmitting areas to enable light from said charge eraser lamp to pass through said brush onto the photosensitive surface.

2. A device as claimed in claim 1, wherein said brush is arranged on said peripheral surface of said cylindrical member in a manner to brush against the photosensitive surface to displace toner thereon and to sequentially expose the entire area thereof to said light through said light transmitting areas.

3. A device as claimed in claim 1, wherein said brush is arranged on said peripheral surface of said cylindrical member in a spiral pattern defining spirally arranged said light transmitting areas.

4. A device as claimed in claim 1, wherein said brush is arranged on said peripheral surface of said cylindrical member in a checkerboard pattern defining said light transmitting areas arranged in a checkerboard pattern.

5. A device as claimed in claim 1, further comprising means for rotating said cylindrical member at a rotational speed sufficient to prevent damage to the photosensitive surface or scattering of toner thereon by contact therewith of said brush.

6. A device as claimed in claim 1, wherein said material of said cylindrical member is capable of screening light from said charge eraser lamp at a wave length which would be harmful to the photosensitive surface.

7. A device as claimed in claim 1, wherein said brush comprises bristles formed of an electrically conductive material.

8. A device as claimed in claim 1, wherein said feed-in means comprises a rotary shaft positioned adjacent said magnetic brush cleaning means at a location upstream of said restricting member with respect to the direction of rotation of said sleeve, said rotary shaft being rotatable about an axis parallel to the axis of rotation of said sleeve, and a transport member fixed to said rotary shaft and rotatable therewith transporting toner removed by said magnetic brush cleaning means to said receptacle.

* * * * *